US007237592B2

(12) United States Patent
Arnoux et al.

(10) Patent No.: US 7,237,592 B2
(45) Date of Patent: Jul. 3, 2007

(54) MANEUVERING MECHANISM AND CLOSING INSTALLATION OR SUN PROTECTION INSTALLATION INCORPORATING ONE SUCH DEVICE

(75) Inventors: Franck Arnoux, Vesoul (FR); Christophe Bresson, Cugney (FR); Benjamin Bousson, Lombard (FR); Hassan Chaiba, Besancon (FR)

(73) Assignee: SIMU, Gray (FR)

( * ) Notice: Subject to any disclaimer, the term of this patent is extended or adjusted under 35 U.S.C. 154(b) by 321 days.

(21) Appl. No.: 10/508,523

(22) PCT Filed: Mar. 27, 2003

(86) PCT No.: PCT/FR03/00974

§ 371 (c)(1),
(2), (4) Date: Sep. 21, 2004

(87) PCT Pub. No.: WO03/083245

PCT Pub. Date: Oct. 9, 2003

(65) Prior Publication Data

US 2005/0126723 A1 Jun. 16, 2005

(30) Foreign Application Priority Data

Mar. 28, 2002 (FR) ..... 02 03940

(51) Int. Cl.
*A47G 1/00* (2006.01)

(52) U.S. Cl. ..... 160/310; 160/192

(58) Field of Classification Search ..... 160/310, 160/311, 188, 191, 192, 315, 318, 317, 189
See application file for complete search history.

(56) References Cited

U.S. PATENT DOCUMENTS

| | | | | |
|---|---|---|---|---|
| 1,117,960 | A * | 11/1914 | McIntyre | 160/313 |
| 1,373,256 | A * | 3/1921 | Mugno, Jr. | 160/265 |
| 2,029,143 | A * | 1/1936 | Wicks | 160/170 |
| 3,739,832 | A * | 6/1973 | Sivin | 160/133 |
| 4,766,941 | A * | 8/1988 | Sloop et al. | 160/241 |
| 5,542,464 | A * | 8/1996 | Shiina | 160/296 |
| 5,711,360 | A * | 1/1998 | Viotte | 160/310 |
| 5,799,716 | A * | 9/1998 | Yamaguchi et al. | 160/310 |
| 5,975,185 | A * | 11/1999 | Miller et al. | 160/310 |
| 2003/0000657 | A1 * | 1/2003 | Dupielet et al. | 160/310 |
| 2004/0045683 | A1 * | 3/2004 | Carrillo et al. | 160/310 |

FOREIGN PATENT DOCUMENTS

| | | |
|---|---|---|
| DE | 42 11 940 A | 10/1993 |
| FR | 2 697 558 A | 5/1994 |

* cited by examiner

*Primary Examiner*—Blair M. Johnson

(57) ABSTRACT

A mechanism (1) comprising a driving element (4) for rotationally driving a winding shaft (2) for a closing or sun-protection installation of an opening (0) and at least one spring (5) for compensating a weight of the installation. The spring (5) is mounted around the driving element (4) and is jointly associated with a sub-unit (10), which can be at least partially introduced in a unitary manner inside the shaft (2). The spring (5) includes a first end (51) kinematically linked to said driving element (4) so that the first end (51) is immobilized in rotation abut an axis of rotation (X-X') of the shaft (2), and a second end (52) kinematically linked to the shaft (2) when the sub-unit (10) is placed inside the shaft (2) so that the second end (52) rotates about the axis of rotation (X-X').

11 Claims, 6 Drawing Sheets

MANEUVERING MECHANISM AND CLOSING INSTALLATION OR SUN PROTECTION INSTALLATION INCORPORATING ONE SUCH DEVICE

BACKGROUND OF THE INVENTION

1. Field of the Invention

The invention relates to a maneuvering mechanism and to a closing or sun-protection installation comprising such a mechanism.

2. Brief Description of Related Art

Closure installation is understood to mean doors, portals, blinds, shutters and equivalent equipment.

In a closing or sun-protection installation, it is known to use a mechanical or electrical driving element for rotating, about its principal geometrical axis, a winding shaft for a closing screen of an opening, or for an effort transmission member such as a strap, associated with such a screen.

It is known to compensate the torque exerted on the winding mechanism by the weight of the closing screen, such compensation being obtained by one or more so-called "compensating" springs. Winding mechanisms comprising compensating springs are known, for example, from FR-A-2 743 107, from DE-A-296 05 670 or from JP-A-2000-234485. In these devices, there are provided, on the one hand, a tubular drive motor and, on the other hand, compensating springs, these springs and this motor having to be placed in position in the winding shaft on the site of use of the installation, while the working conditions of the installer are sometimes precarious, particularly due to a limited accessibility in height. In addition, numerous parts must be provided in order to install, on the one hand, the compensating spring and, on the other hand, the motor inside the winding shaft, this rendering the known installations more expensive.

It is a more particular object of the invention to overcome these drawbacks by proposing a maneuvering mechanism which comprises at least one compensating spring and which may be easily placed in position, while its cost price is more attractive than that of the known compensated mechanisms.

SUMMARY OF THE INVENTION

In this spirit, the invention relates to a mechanism for maneuvering a closing or sun-protection installation comprising an element for driving in rotation a winding shaft for a closing screen and at least one spring for compensating the weight of this closing screen. This mechanism is characterized in that the spring is mounted around the driving element and belongs with the latter to a sub-unit adapted to be at least partially introduced in unitary manner inside the winding shaft, a first end of the spring being kinematically linked to the driving element, while its second end is adapted to be kinematically linked to this shaft when the sub-unit is in place in the shaft.

Thanks to the invention, the driving element, which may be an electric motor, and the compensating spring may be manipulated and placed in position in a relatively simple operation, this facilitating the work of the installer, reducing the assembly time and reducing the number of accessory parts necessary.

According to advantageous but non-obligatory aspects of the invention, this mechanism incorporates one or more of the following characteristics:

- The second end of the spring is fast with a driving element adapted to be connected with the shaft, inside the latter.
- The second end of the spring is fast with a ring mounted to rotate freely about a casing of the driving element. This ring is advantageously fast in rotation with an output shaft of the driving element. In a variant, it may be rendered directly fast in rotation with the winding shaft, with the result that the output shaft of the driving element is not urged by the compensating spring. This makes it possible to avoid the reduction gear conventionally provided at the output of an electric motor being subjected during a relatively long storage period to an effort exerted on the output shaft by the loaded spring in a configuration of compensation of the maximum torque exerted by the closing screen. In particular, the ring may be provided to present at least one element in relief adapted to come into mesh with a corresponding element in relief provided on the winding shaft for connection of this ring and this shaft in rotation.
- The first end of the spring is anchored on a casing of the driving element.
- The first end of the spring is fast in rotation with a ring immobilized around a casing of the driving element.
- The spring has such a length that it does not project substantially, in an axial direction, with respect to a casing of the driving element.
- The driving element may comprise an electric motor, possibly associated with a reduction gear.

The invention also relates to an installation for closure or sun protection which comprises a maneuvering mechanism as described previously. Such an installation is easier to position and more economical than those of the state of the art.

The invention will be more readily understood and other advantages thereof will appear more clearly in the light of the following description of three forms of embodiment of a closure installation equipped with a maneuvering mechanism according to the invention, given solely by way of example and made with reference to the accompanying drawings, in which:

DETAILED DESCRIPTION OF PREFERRED EMBODIMENTS

Figure 1:
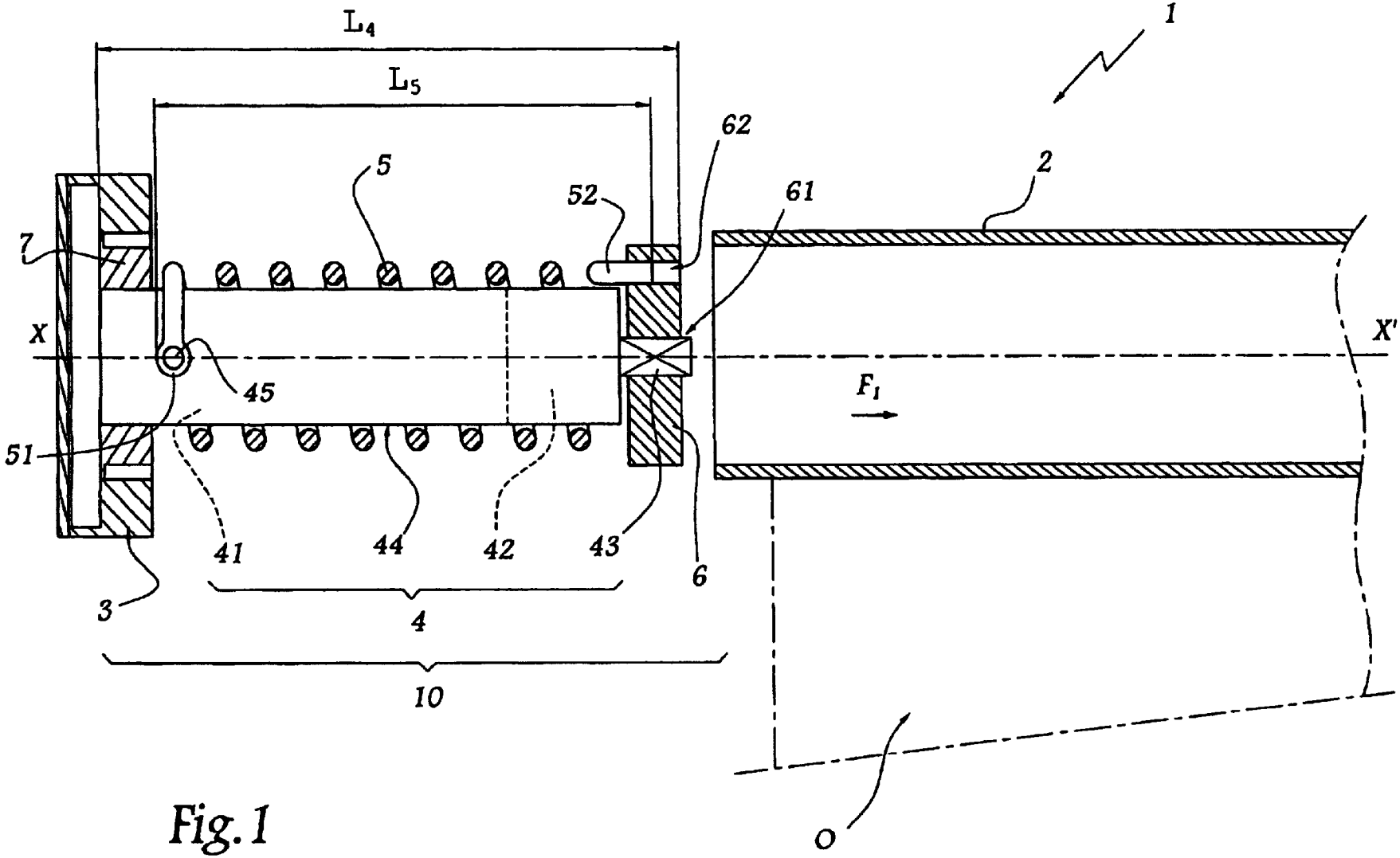
FIG. 1 schematically shows a partial axial section of a part of a closure installation in the course of assembly.
Figure 2:
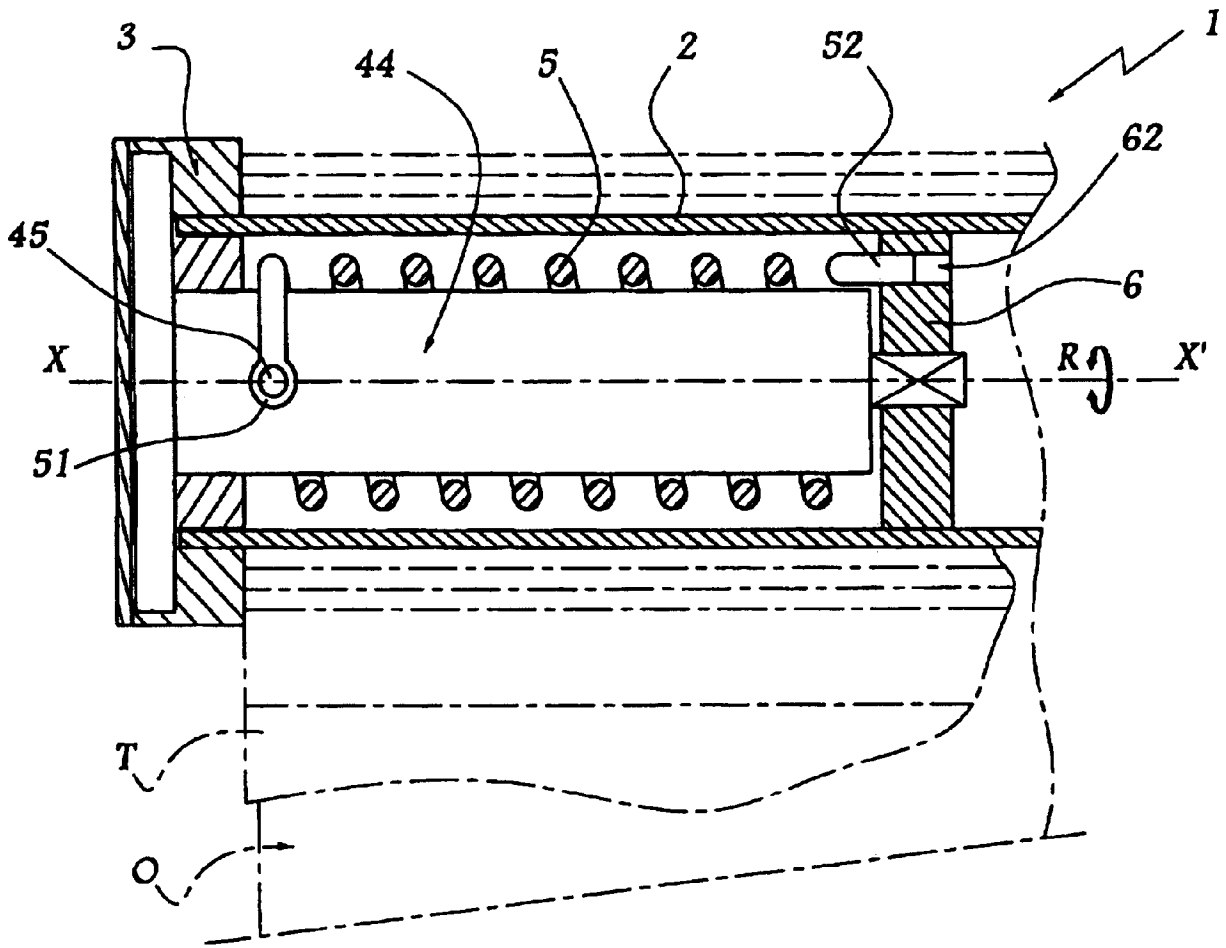
FIG. 2 is a partial axial section of the installation of FIG. 1 in configuration of use.

The installation shown partially in FIGS. 1 and 2 comprises a mechanism 1 making it possible to wind a screen body T more or less around a geometrical axis X-X', this making it possible to close more or less an opening O made in the masonry of a building.

The mechanism 1 comprises a shaft 2 whose central geometrical axis merges with axis X-X' and which is supported with respect to the structure of the building by means of a bracket 3 forming bearing.

A driving element 4 is provided to rotate the shaft about axis X-X', as represented by arrow R in FIG. 2. This element comprises an electric motor 41 and a reduction gear 42. 43 denotes the output shaft of the element 4, and 44 its casing inside which elements 41 and 42 are housed.

A compensating spring 5 is provided in order to compensate the torque exerted by the weight of the screen body T about the axis X-X'. This spring is a torsion spring disposed helically around the casing 44 of the element 4.

The casing 44 is provided with a catch 45 around which is anchored a first end 51 of the spring 5 which is shaped as a loop.

The second end 52 of the spring 5 is introduced in a housing 62 made in a drive disc 6 provided to be connected in rotation with the shaft 2 by any appropriate means, for example by riveting.

The disc 6 is provided with a central opening 61 whose section is adapted to the section of the shaft 43, with the result that the disc 6 is fast in rotation with the shaft 43.

A spacer ring 7 is provided in order to centre the casing 44 in the shaft 2, with possibility of rotation.

As is more particularly visible in FIG. 1, elements 3 to 7 constitute a sub-unit 10 which may be partially introduced, in one operation, inside the shaft 2, as represented by arrow $F_1$. In particular, the element 4 and the spring 5 belong to the unit 10 and are positioned in the shaft 2.

$L_5$ denotes the length of the spring 5 taken in the direction of axis X-X'. $L_4$ denotes the length of the element 4 taken in the same direction. The length $L_5$ is less than length $L_4$ and the spring 5 substantially does not project beyond the casing 44, this giving the sub-unit 7 a compact and monolithic character, simplifying its manipulation and allowing time to be saved when installing.

When the device is in operational configuration shown in FIG. 2, a rotation R of the shaft 2 induces a corresponding rotation of the disc 6 and a modification of the tension of the spring 5, since its end 52 rotates about axis X-X', while its end 51 remains fixed with respect to the casing 44 which is itself fixed with respect to axis X-X'.

Figure 3:
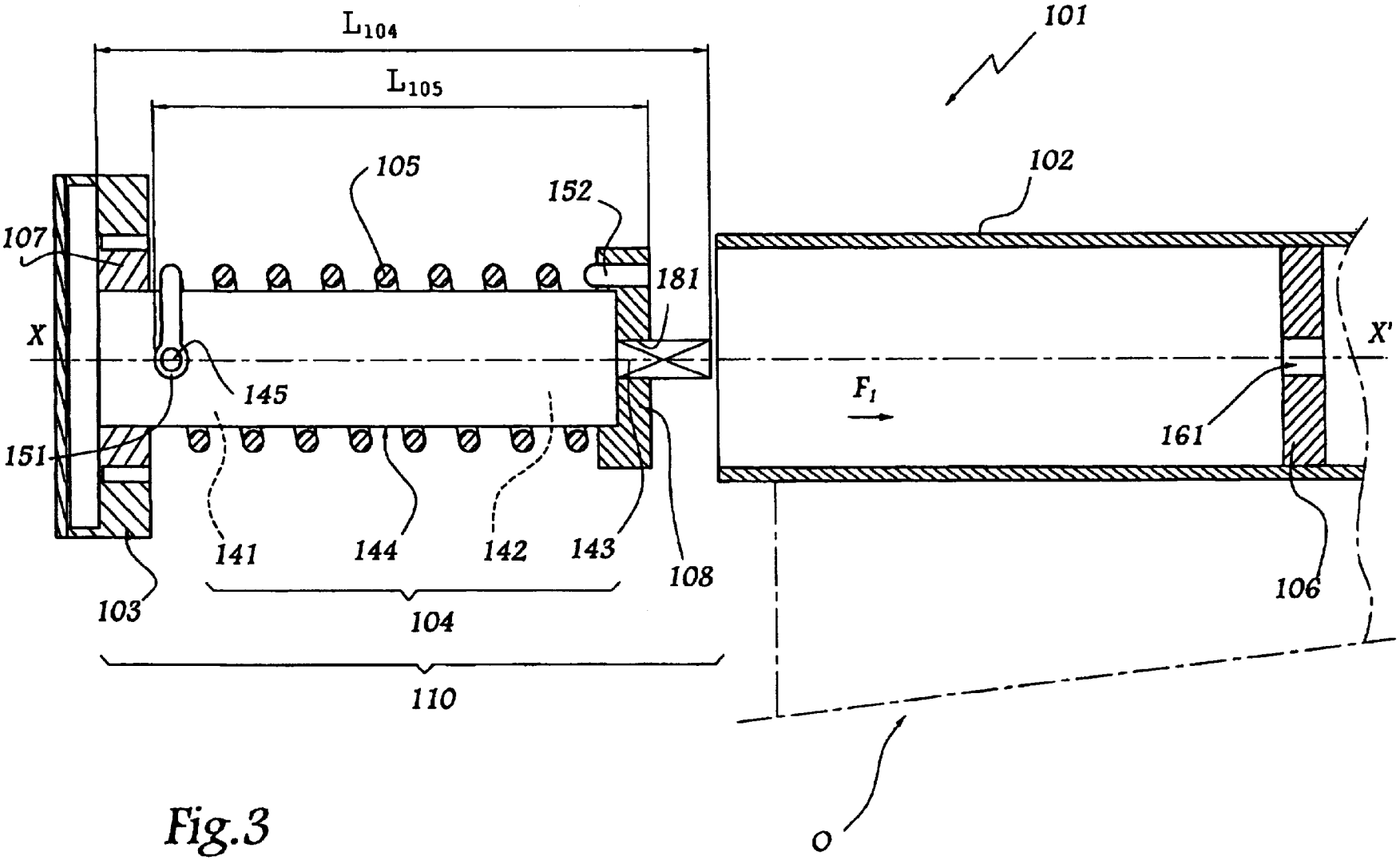
FIG. 3 is a section similar to FIG. 1, for an installation in accordance with a second form of embodiment of the invention.
Figure 4:
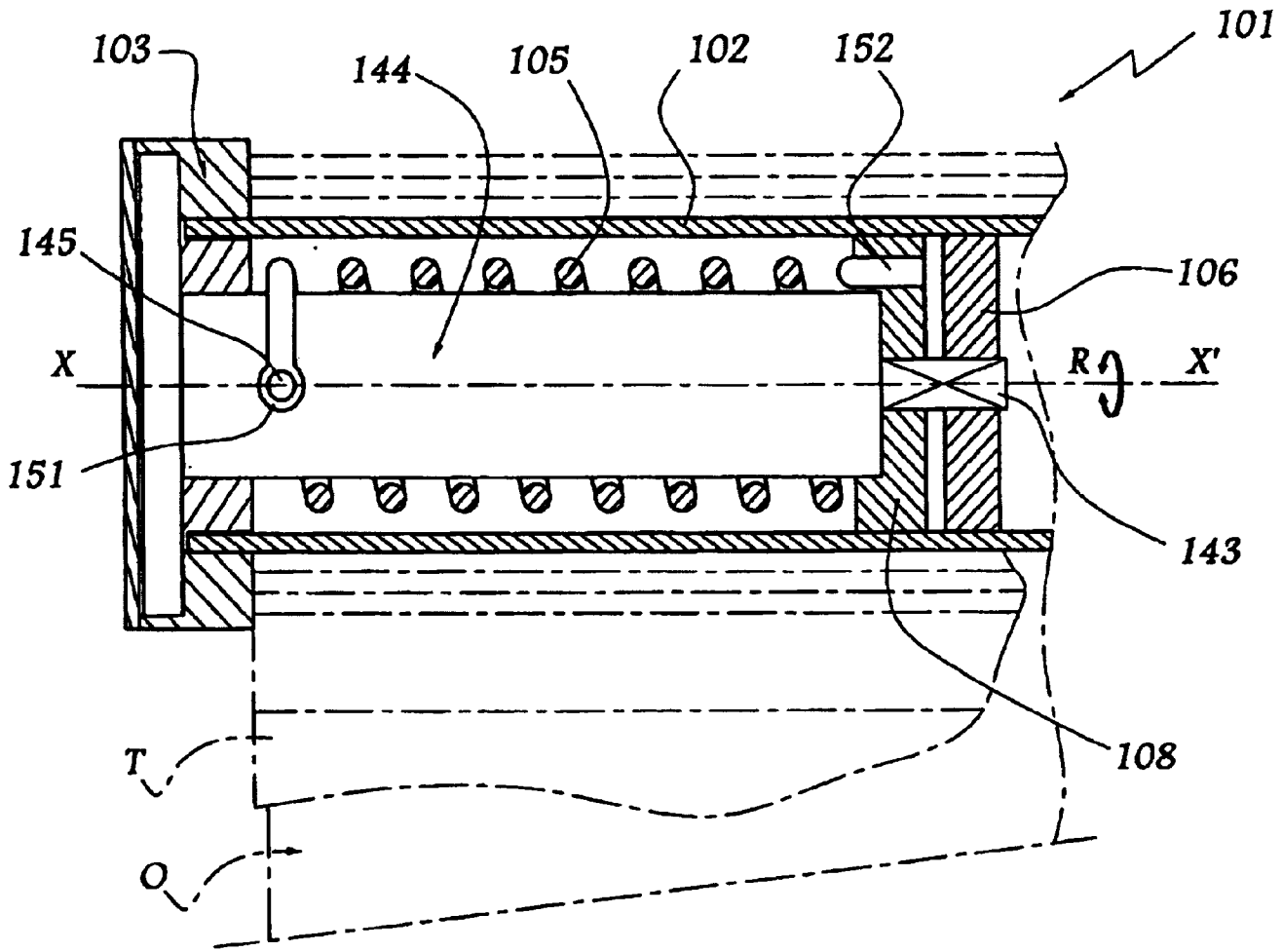
FIG. 4 is a section similar to FIG. 2 for the installation of FIG. 3.

In the second embodiment of the invention shown in FIGS. 3 and 4, elements similar to those of the first embodiment bear identical references increased by 100. The mechanism 101 of this embodiment is likewise centred on an axis X-X' and comprises a shaft 102 for winding a screen body T, this shaft being supported thanks to a bracket 103 and receiving a driving element 104 comprising an electric motor 141 and a reduction gear 142. As previously, a spring 105 is mounted around the casing 144 of the element 104, this spring being fast by its first end 151 with a catch 145 provided on the casing 144.

A spacer ring 107 is disposed around the casing 144, in the vicinity of the bracket 103, with possibility of rotation, and allows a relative centering of the elements 102 and 104.

A ring 108 is mounted to rotate freely about the end 144*a* of the casing 144 opposite the bracket 103, this ring 108 being provided with a central opening 181 whose section is such that it may be driven in rotation by the output shaft 143 of the element 104. The second end 152 of the spring 105 is fixed by any appropriate means on the ring 108, for example by cooperation of shapes, clipping, gluing or welding.

A drive disc 106 is fixed inside the tube 102 when it is manufactured and is provided with an opening 161 for receiving the shaft 143, the section of the opening 161 allowing a drive in rotation of the disc 106 from the shaft 143.

The elements 103 to 107 and 108 constitute a sub-unit 110 which may be partially introduced in one operation inside the tube 102, as represented by arrow $F_1$ in FIG. 3.

The length $L_{105}$ of the spring 105 parallel to axis X-X' is less than the length $L_{104}$ of the element 104 parallel to this axis.

Figure 5:
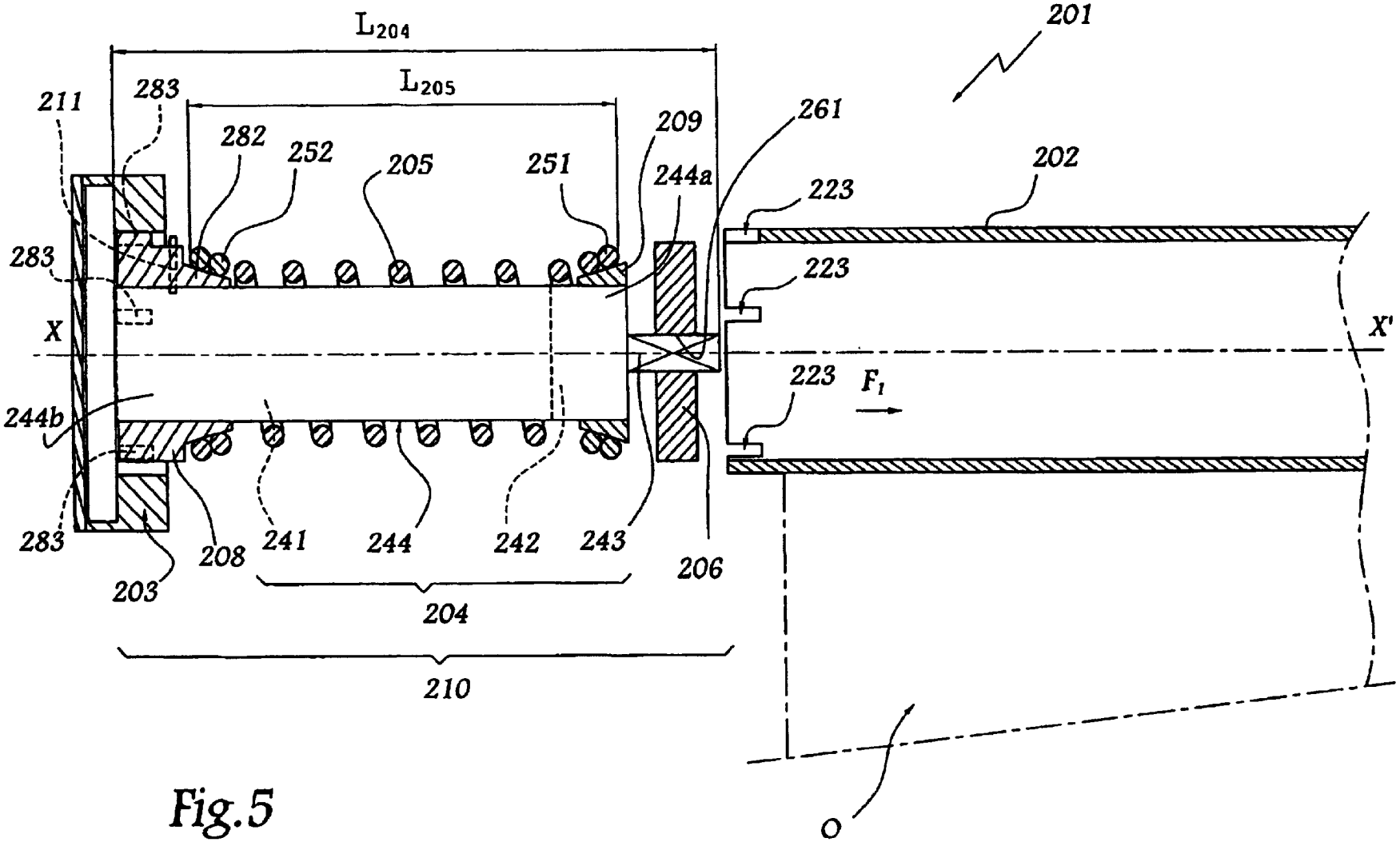
FIG. 5 is a section similar to FIG. 1, for an installation in accordance with a third form of embodiment of the invention.
Figure 6:
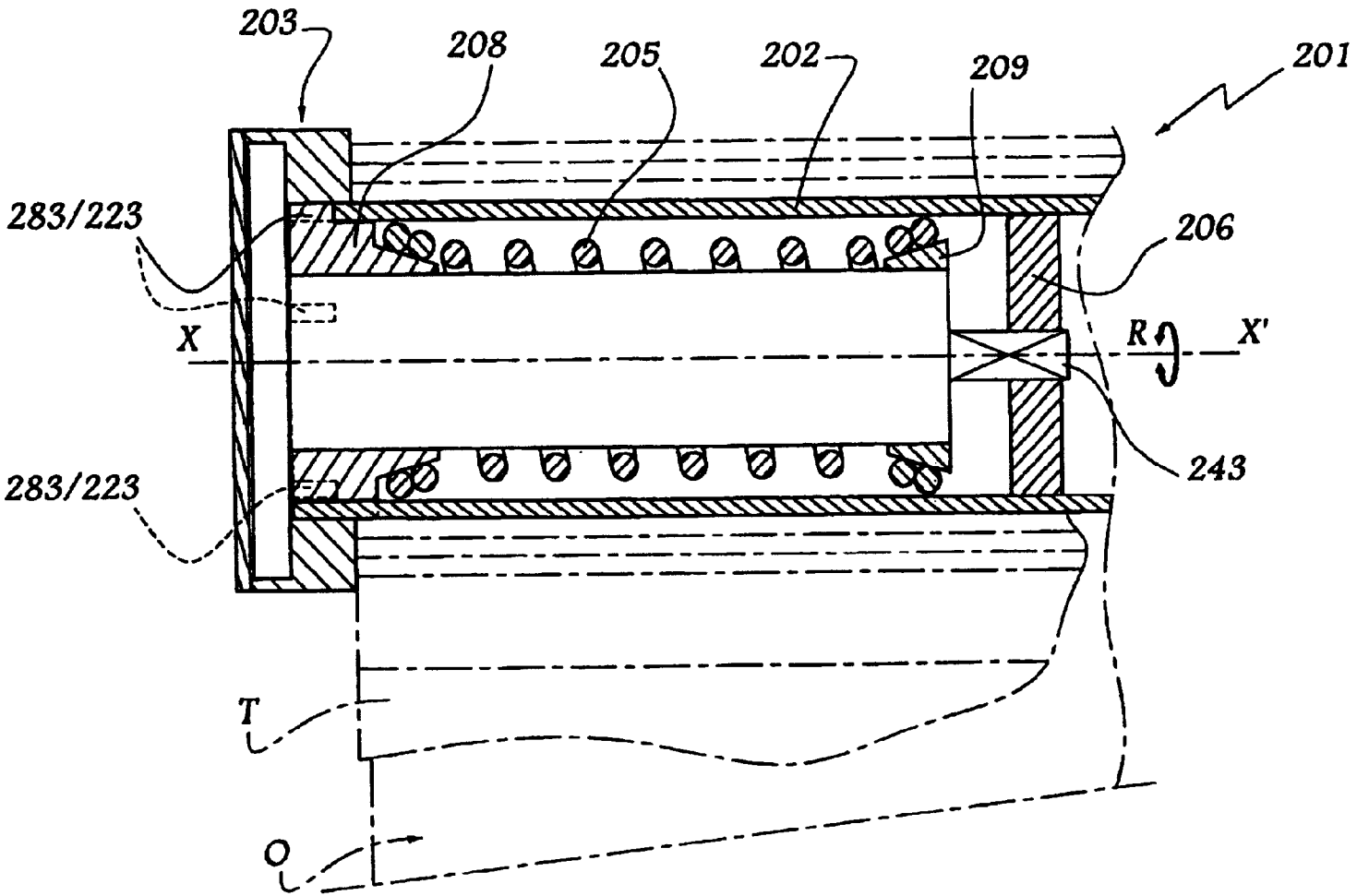
FIG. 6 is a section similar to FIG. 2 for the installation of FIG. 5.

In the third form of embodiment of the invention shown in FIGS. 5 and 6, elements similar to those of the first embodiment bear identical references increased by 200. The mechanism 201 of this embodiment comprises a shaft 202 for driving a screen body T for more or less closing an opening O. This shaft 202 is supported by a bracket 203 immobilized with respect to the masonry of the building. A driving element 204 comprises an electric motor 241 and a reduction gear 242 disposed inside a casing 244 of cylindrical shape with circular section, like casings 44 and 144.

243 denotes the output shaft of the member 204. This shaft 243 is provided to be introduced in an opening 261 of a drive disc 206 mounted fixed inside the shaft 202.

A spring 205 is mounted around the casing 244 and immobilized in rotation thereon by clamping its first end 251 on a truncated ring 209, itself immobilized on the end 244*a* of the casing 244 opposite the bracket 203.

Another ring 208 is mounted around the casing 244, at the level of its end 244*b* nearest the bracket 203, the ring 208 being able to rotate about the end 244*b*.

The ring 208 is, furthermore, provided with a truncated surface 282 for receiving and wedging the second end 252 of the spring 205.

The ring 208 is also provided with a plurality of radial projections 283 intended each to be engaged in a notch 223 made at the level of the end 221 of the tube 202.

The elements 203 to 205, 208 and 209 constitute a sub-unit 210 that may be introduced in one operation, represented by arrow $F_1$ in FIG. 5, inside the tube 202, this sub-unit making it possible to perform the functions of drive of the tube 202 and of compensation, like the sub-units 10 and 110 of the first and second embodiments.

Due to the introduction of the sub-unit 210 in the tube 202, the shaft 243 comes into engagement inside the opening 261, while the projections 283 come into engagement in the notches 223.

As shown in FIG. 5, when the installation is being placed in position, the ring 206 is mounted on the shaft 243 before the sub-unit 210 is introduced in the tube 202, this avoiding a later adjustment of the relative orientation of the rings 206 and 208. The same modus operandi may be employed with the mechanisms of the first and second embodiments.

This form of embodiment presents the particular advantage that, in the configuration of FIG. 5 of the sub-unit 210, which corresponds to its configuration of storage before being placed in position in an installation provided on a building, the torque exerted by the spring 205 between the rings 208 and 209 is not transmitted to the shaft 243. In effect, there is provided a means for immobilizing the ring 208 in rotation with respect to the casing 244, this means being able to be a key 211 as shown in dashed and dotted lines in FIG. 5. Any other immobilization means may, however, be envisaged, for example a fixation by screwing.

The position of the ring 208 may be adjusted, before its immobilization with respect to the casing 244, so that the effort of compensation exerted by the spring 205 corresponds substantially to the effort of compensation to be exerted in order to compensate the maximum weight of the screen body T, i.e. its weight in closed configuration of the opening O. This maximum torque not being transmitted to the shaft 243 and consequently to the reduction gear 242, this reduction gear may be dimensioned, taking into account the fact that, when the sub-unit 210 is in place in the shaft 202, the weight of the screen body T and the effort of the spring 205 are compensated approximately. The reduction gear 242 may therefore be smaller and lighter than the reduction gears of the known installations, this enabling substantially savings to be made on the cost price of the mechanism 201.

The length $L_{205}$ of the spring 205 is substantially shorter than the total length of the element 204.

According to a variant of the invention (not shown), a mechanism in accordance with its principle may also be equipped with a safety device as described in French Patent Application No. 02 03942, corresponding to U.S. patent publication No. 2005/0109473 of which the contents are incorporated herein by reference.

The technical characteristics of the different forms of embodiment mentioned may be combined together without departing from the scope of the present invention. Similarly, obvious modifications may be made to the embodiments described without departing from the scope of the present invention.

The invention claimed is:

1. A mechanism for maneuvering a closing or sun-protection installation comprising:

an element for driving in rotation a winding shaft for the closing or sun-protection installation, the element for driving comprising a motor; and at least one spring for compensating for a weight of the screen, said spring is mounted around said element for driving, said spring including a first end and a second end, wherein said spring and said element for driving belong to a sub-unit adapted to be at least partially introduced in a unitary manner inside the winding shaft, and wherein said first end of said spring is kinematically linked to said element for driving so that said first end is immobilized in rotation about an axis of rotation (X-X') of the winding shaft, while said second end is kinematically linked to the winding shaft when said sub-unit is in place in the winding shaft so that said second end rotates about the axis of rotation (X-X').

2. The mechanism according to claim 1, wherein said second end of said spring is attached to a driving element adapted to be connected with the winding shaft.

3. The mechanism according to claim 1, wherein said second end of said spring is attached to a ring mounted to rotate freely about said element for driving.

4. The mechanism according to claim 3, wherein said ring is adapted to rotate with an output shaft of said element for driving.

5. The mechanism according to claim 3, wherein said ring is adapted to rotate with the winding shaft.

6. The mechanism according to claim 5, wherein said ring includes at least one element in relief adapted to interact with a corresponding element in relief provided on the winding shaft for connecting said ring and the winding shaft.

7. The mechanism according to claim 1, wherein said first end of said spring is attached to a casing of said element for driving.

8. The mechanism according to claim 1, wherein said first end of said spring is adapted to rotate with a ring immobilized around a casing of said element for driving.

9. The mechanism according to claim 1, wherein said spring has such a length ($L_5$; $L_{105}$; $L_{205}$) so that said spring does not project substantially, in an axial direction along the axis of rotation (X-X'), from a casing of said element for driving.

10. The mechanism according to claim 1, said motor comprises an electric motor.

11. A closing or sun-protection installation, comprising a mechanism, said mechanism including:

an element for driving in rotation a winding shaft for the closing or sun-protection installation the element for driving comprising a motor; and at least one spring for compensating for a weight of the screen, said spring is mounted around said element for driving, said spring having a first end and a second end, wherein said spring and said element for driving belong to a sub-unit adapted to be at least partially introduced in a unitary manner inside the winding shaft, and wherein said first end of said spring is kinematically linked to said element for driving so that said first end is immobilized in rotation about an axis of rotation (X-X') of the winding shaft, while said second end is kinematically linked to the winding shaft when said sub-unit is in place in the winding shaft so that said second end rotates about the axis of rotation (X-X').

* * * * *